US005970762A

United States Patent [19]

Myers et al.

[11] Patent Number: 5,970,762

[45] Date of Patent: Oct. 26, 1999

[54] LOCK PLUG ASSEMBLY AND A TUMBLER WITH A BENT-OVER END THEREFOR

[75] Inventors: Gary L. Myers, Monee; Stanislav Jezek, LaGrange Highlands, both of Ill.

[73] Assignee: Fort Lock Corporation, River Grove, Ill.

[21] Appl. No.: 08/728,887

[22] Filed: Oct. 10, 1996

[51] Int. Cl.[6] ..... B05B 29/02

[52] U.S. Cl. ..... 70/492; 70/369; 70/377; 70/421

[58] Field of Search ..... 70/377, 492, 376, 70/392, 421, 369, 373, 495

[56] References Cited

U.S. PATENT DOCUMENTS

| | | | |
|---|---|---|---|
| 838,910 | 12/1906 | Schroeder | 70/492 X |
| 1,850,323 | 3/1932 | Heyer | 70/377 |
| 1,893,142 | 1/1933 | Jacobi | 70/377 |
| 1,906,701 | 5/1933 | Maxwell et al. | 70/421 |
| 1,979,939 | 11/1934 | Jacobi | 70/376 |
| 1,990,934 | 2/1935 | Falk | 70/377 X |
| 2,061,456 | 11/1936 | Falk . | |
| 2,123,940 | 7/1938 | Gray | 70/377 |
| 3,137,156 | 6/1964 | Navarro . | |
| 3,263,461 | 8/1966 | Tartaglia | 70/492 X |
| 3,509,749 | 5/1970 | Regan et al. | 70/492 |
| 3,690,132 | 9/1972 | Engstrom | 70/373 |
| 3,699,790 | 10/1972 | Ansala | 70/492 |
| 3,854,311 | 12/1974 | Mercurio | 70/377 X |
| 3,863,476 | 2/1975 | Patriquin | 70/419 |
| 3,877,268 | 4/1975 | Shull | 70/492 |
| 4,292,823 | 10/1981 | Reinhard et al. | 70/377 X |
| 4,398,405 | 8/1983 | Patriquin | 70/369 |
| 4,644,768 | 2/1987 | Nowak et al. | 70/377 X |
| 4,671,090 | 6/1987 | Masaki et al. | 70/423 X |
| 4,964,494 | 10/1990 | Eisermann | 70/369 X |
| 4,972,695 | 11/1990 | Mochida et al. | 70/492 |
| 5,088,305 | 2/1992 | Myers | 70/369 |
| 5,119,654 | 6/1992 | Ceron et al. | 70/369 |
| 5,134,871 | 8/1992 | Makino et al. | 70/492 |
| 5,265,455 | 11/1993 | Grimmer | 70/377 X |
| 5,653,131 | 8/1997 | Shibata et al. | 70/492 X |
| 5,687,594 | 11/1997 | Wang | 70/377 X |

FOREIGN PATENT DOCUMENTS

| | | | |
|---|---|---|---|
| 723881 | 12/1965 | Canada | 70/492 |
| 0 350 474 | 1/1990 | European Pat. Off. . | |
| 659496 | 6/1929 | France | 70/423 |
| 1089091 | 3/1955 | France | 70/492 |
| 3143638 | 5/1983 | Germany | 70/492 |
| 374704 | 6/1932 | United Kingdom | 70/492 |
| 498089 | 1/1939 | United Kingdom | 70/492 |
| 924515 | 4/1963 | United Kingdom . | |
| 2 067 645 | 7/1981 | United Kingdom . | |

*Primary Examiner*—Lloyd A. Gall
*Attorney, Agent, or Firm*—Banner & Witcoff, Ltd.

[57] ABSTRACT

A reciprocating combinating tumbler for a lock plug assembly which includes a flat body portion and a bent-over (or enlarged) end portion is provided for use with a lock plug barrel having a generally cylindrical outer periphery, a longitudinal axis, a keyway slot formed substantially along the longitudinal axis, and a plurality of spaced-apart cavities formed substantially perpendicular to the keyway slot. In use, the tumbler reciprocates between an extended position wherein the bent-over end portion is spaced radially outwardly of the outer periphery of the lock plug barrel and protrudes into a longitudinal spline formed in the aperture of a housing, and a retracted position wherein the bent-over end portion is spaced radially inwardly of the outer periphery of the barrel and does not protrudes into the longitudinal spline. When the tumbler is in the extended position, the bent-over end portion provides resistance to cutting, shearing, and breaking by supplying additional surface contact between the bent-over end portion of the tumbler and the longitudinal spline of the aperture thereby making it more difficult to force the tumbler through the plastic material which surrounds the longitudinal spline. The tumbler is movable into the retracted position when the keyway slot of the barrel and the opening of the flat body portion is received by a properly-fitting key.

5 Claims, 3 Drawing Sheets

FIG.1
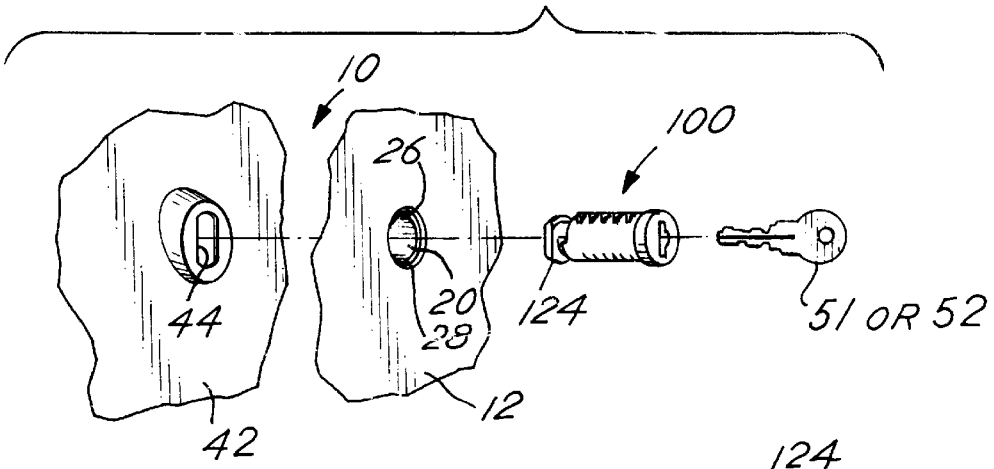
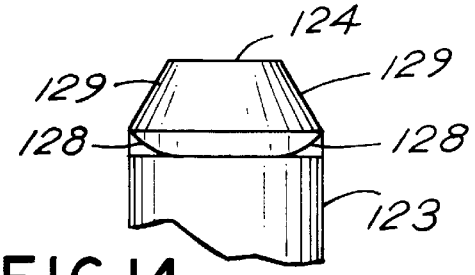
FIG.14
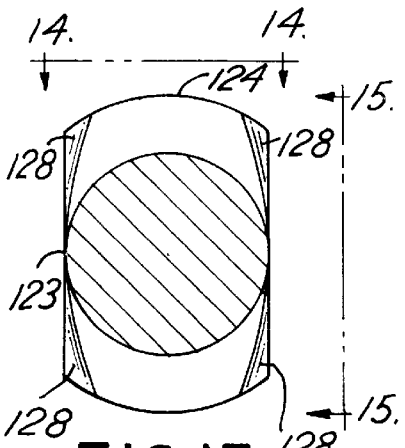
FIG.13
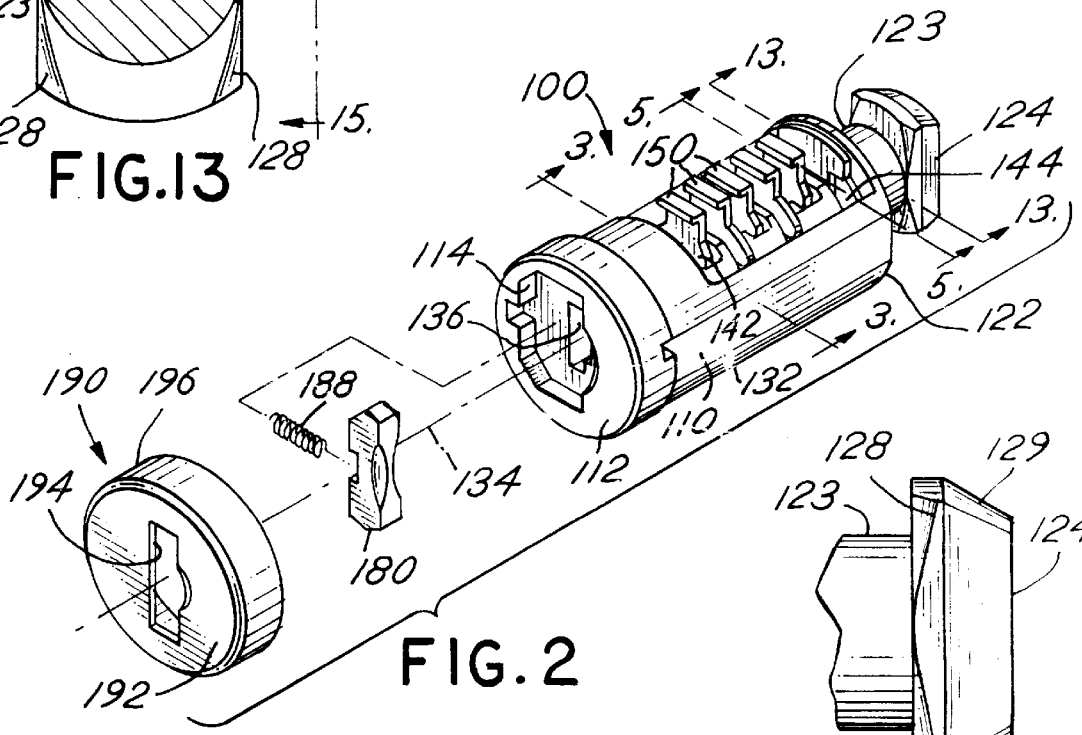
FIG. 2
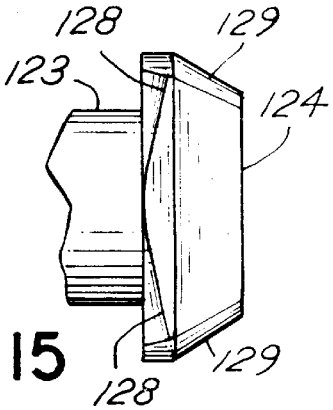
FIG.15

LOCK PLUG ASSEMBLY AND A TUMBLER WITH A BENT-OVER END THEREFOR

TECHNICAL FIELD OF THE INVENTION

The present invention relates generally to lock mechanisms and, more particularly, to a lock plug assembly and a bent-over reciprocating combinating tumbler therefor.

BACKGROUND OF THE INVENTION

Lock mechanisms which utilize reciprocating combinating tumblers are well known in the art. Such lock mechanisms are commonly used, for example, to prevent unauthorized access to a place (e.g., a house, an apartment, an office, a desk, etc.) and to prevent the removal of objects therefrom. Such lock mechanisms are also used to secure transportable goods (e.g., skis, luggage, bicycles, surfboards, canoes, etc.) to a vehicle. In most instances, a transporter system (commonly known as a "load carrier") is mounted to the roof of the vehicle and the transportable goods are locked thereto. Examples of load carriers include ski racks, luggage racks, and boat carriers.

Most load carriers include a framework which is assembled from discrete component parts. In order to provide sufficient strength and durability to the framework as a whole, each component part is typically fabricated from either metal or high impact plastic material (e.g., polycarbonate plastic). A key-operated lock mechanism is also provided for locking the transportable goods to the framework. The lock mechanism usually comprises a conventional lock plug assembly having a plurality of flat reciprocating metal tumblers disposed therein. In most instances, the lock plug assembly is received by an aperture formed in one or more of the high impact plastic component parts of the framework. Of course, in order to prevent rotation of the lock plug assembly when its in its locked position (i.e., when the tumblers are extended), the aperture must include at least one longitudinal spline.

One notable disadvantage of such lock mechanisms is that the metal tumblers can be used to cut through the high impact plastic material of the framework, especially when the load carrier is subjected to cold temperatures. For example, when a tool or utensil is inserted into the lock plug assembly and a sufficient rotational force is applied thereto, the flat metal tumblers will cut, shear, or break through the plastic material which surrounds the aperture (i.e., the plastic material immediately adjacent to the spline). In this way, vandals or thieves may defeat the lock mechanism and gain access to the goods being transported by the vehicle. Of course, when the lock mechanism is defeated in this way, the framework of the load carrier is also damaged.

An additional deficiency of such lock plug assemblies is that they are very difficult, if not impossible, to remove from the framework of the load carrier during replacement, repair and/or servicing because the rear portion of such lock plug assemblies is generally inaccessibly positioned within the aperture. A further inconvenience associated with such lock plug assemblies is that snow, ice, dust, and other debris can enter the keyway slot which may damage the tumblers and/or cause the lock mechanism to freeze-up or become inoperable.

OBJECTS OF THE INVENTION

Accordingly, a general object of the present invention is to provide a lock plug assembly which resists cutting, shearing, or breaking through plastic material when a rotational force is applied thereto.

A more specific object of the present invention is to provide a reciprocating combinating tumbler for a lock plug assembly which resists cutting, shearing, or breaking through high impact plastic material when a rotational force is applied to the lock plug assembly in a cold temperature environment.

Another object of the present invention is to provide a lock plug assembly that is removable from its housing.

A further object of the present invention is to provide a lock plug assembly that prevents snow, ice, dust, and other debris from entering the keyway slot thereof.

Still another object of the present invention is to provide a lock plug assembly having the foregoing characteristics which is not only simple and relatively inexpensive to manufacture, but is also reliable and convenient to use.

These and other objects, features, and advantages of the present invention will become apparent upon reading the following detailed description of a preferred exemplified embodiment and upon reference to the accompanying drawings.

SUMMARY OF THE INVENTION

The above objects are accomplished by providing a reciprocating tumbler for a lock plug assembly which has a flat body portion and a bent-over (or enlarged) end portion. The lock plug assembly includes a barrel which is adapted to be received by an aperture in a plastic housing. The barrel includes a generally cylindrical outer periphery, a longitudinal axis, a keyway slot formed substantially along the longitudinal axis, and a plurality of spaced-apart cavities formed substantially perpendicular to the keyway slot. The flat body portion of the tumbler is received by one of the cavities of the barrel and includes an opening formed through its thickness. In use, the tumbler reciprocates between an extended position wherein the bent-over end portion is spaced radially outwardly of the outer periphery of the barrel and protrudes into a longitudinal spline formed in the aperture of the housing and a retracted position wherein the bent-over end portion is spaced radially inwardly of the outer periphery of the barrel and does not protrudes into the longitudinal spline. The tumbler is movable into the retracted position when the keyway slot of the barrel and the opening of the flat body portion is received by a properly-fitting normal key.

During an attempted theft or an act of vandalism or tampering, the bent-over end portion of the tumbler provides resistance to cutting, shearing, breaking, or the like when a rotational force is applied to the lock plug assembly. In particular, the additional surface contact between the bent-over end portion of the tumbler and the spline of the aperture makes it more difficult to force the tumbler through the plastic material which surrounds the aperture (i.e., the plastic material adjacent to the spline).

A substantially flat retention tumbler disposed in the rearwardmost cavity of the barrel is also provided in order to permit the lock plug assembly to be removed from the aperture of the housing when a specially adapted removal key is inserted therein. Also, a dust shutter arranged in a void formed in the front end of the barrel and disposed adjacent to a cap which covers the forward end of the barrel is also provided in order to prevent snow, ice, dust, and other debris from entering the keyway slot of the lock plug assembly.

BRIEF DESCRIPTION OF THE DRAWINGS

FIG. 1 is an exploded perspective view of a lock plug assembly having tumblers constructed in accordance with the present invention, here showing the lock plug assembly receiving a key and being received by an aperture in a housing;

FIG. 2 is an enlarged exploded perspective view of the lock plug assembly depicted in FIG. 1, with the elements of the lock plug assembly (i.e., the reciprocating combinating tumblers, the retention tumbler, the dust shutter assembly, and the lock plug cover) shown in greater detail;

FIG. 13 is a cross-sectional view of the rear end of the lock plug assembly taken along line 13—13 in FIG. 2;

FIG. 14 is a top plan view of the rear end of the lock plug assembly as seen in the direction of line 14—14 in FIG. 13; and FIG. 15 is a side elevational view of the rear end of the lock plug assembly as seen in the direction of line 15—15 in FIG. 13.

Figure 3:
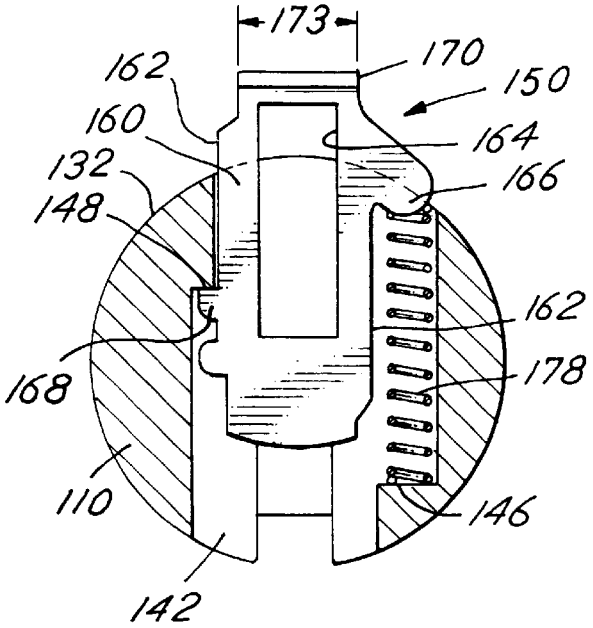
FIG. 3 is an enlarged transverse cross-sectional view of the lock plug assembly taken along line 3—3 of FIG. 2, with one of the reciprocating combinating tumblers in an extended position.

While the present invention will be described and disclosed in connection with a preferred embodiment, the intent is not to limit the present invention to this specific embodiment. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Referring now to the drawings, wherein similar reference numerals denote similar elements throughout the several views, a lock plug assembly constructed in accordance with the teachings of the present invention is generally designated by reference numeral 100. In use, the lock plug assembly 100 of the present invention is adapted to be selectively rotated within an aperture 20 of a housing 10 upon receipt and rotation of a properly-fitting first key (i.e., a normal key) 51.

As illustratively shown in FIG. 1, the housing 10 may include a forward part 12 which includes aperture 20, and a separate rearward part 42. A bayonet-type connection between a lug portion 124 of the lock plug assembly 100 and the rearward part 42 of the housing 10 may be used to conveniently unite the forward and rearward parts 12 and 42 of the housing 10, as shown, for example, in FIG. 1. In practice, the lug 124 of the lock plug assembly 100 is initially received by a similarly shaped opening 44 in the rearward part 42 of the housing 10. When the lock plug assembly 100 is rotated 90° with respect to the position shown in FIG. 1, however, the lug 124 causes the forward and rearward parts 12 and 42 of the housing 10 to become joined together. Typically, both the forward and rearward parts 12 and 42 of the housing 10 are formed of a high impact material (i.e., a material which exhibits brittle behavior at colder temperatures), such as polycarbonate plastic.

As best shown in FIG. 2, the lock plug assembly 100 of the present invention includes a barrel 110 having a plurality of reciprocating combinating tumblers 150 disposed therein. The lock plug barrel 110, in particular, includes a front end 112, a rear end 122 (with lug 124), a generally cylindrical outer periphery 132, a longitudinal axis 134, a generally rectangular keyway slot 136 formed substantially along the longitudinal axis 134, and a plurality of spaced-apart cavities 142 extending radially inwardly from the outer periphery 132 and arranged generally perpendicular to the keyway slot 136 for receiving the tumblers 150. Moreover, the lug 124 is spaced-apart from the rear end 122 of the lock plug barrel 110 by a generally cylindrical shaft portion 123, as shown in FIGS. 2, 7, 9, and 11, and the cavities 142 are spaced-apart by a predetermined distance 145, as shown, for example, in FIG. 7.

Preferably, the lock plug barrel 110 is formed of a high strength, durable material, including, for example, certain molded plastics. In order to provide added strength to the lug portion 124 of the lock plug barrel 110, a generally conical void 126 may be formed in the end of the lug 124 during the molding process, as shown, for example, in FIGS. 7–9 and 11–13. As the lock plug barrel 110 is being molded, void 126 helps keep the material thickness of the lug 124 relatively uniform which not only helps reduce stress concentrations, but also helps prevent material defects, such as air bubbles. As best shown in FIGS. 2 and 13–15, the lug 124 also includes tapered (or curved) break edges 128, as well as inwardly sloping faces 129. In operation, the inwardly sloping faces 129 permit the lug 124 to be more easily received by the opening 44 of the rearward part 42 of the housing 10, while the tapered break edges 128 help draw the lug 124 into secure engagement with the opening 44 by providing camming surfaces between the lug 124 and the rearward part 42 of the housing 10.

Aside from aperture 20, the forward part 12 of the housing 10 also includes a forward end 22, an aft end 24, and a pair of diametrically opposed longitudinal splines 26 and 28 extending from the forward end 22 thereof, as shown in FIGS. 1, 7, 9, and 11. In order to prevent rotation of the lock plug assembly 100 within the aperture 20 of the housing 10, the tumblers 150 of the lock plug assembly 100 are selectively received by the splines 26 and 28. The housing 10 also includes a front exterior surface 14 which forms a substantially contiguous surface with the front end 112 of the lock plug barrel 110 when the lock plug assembly 100 is fully inserted into the aperture 20 of the housing 10, as shown, for example, in FIGS. 7, 9, and 11.

Figure 4:
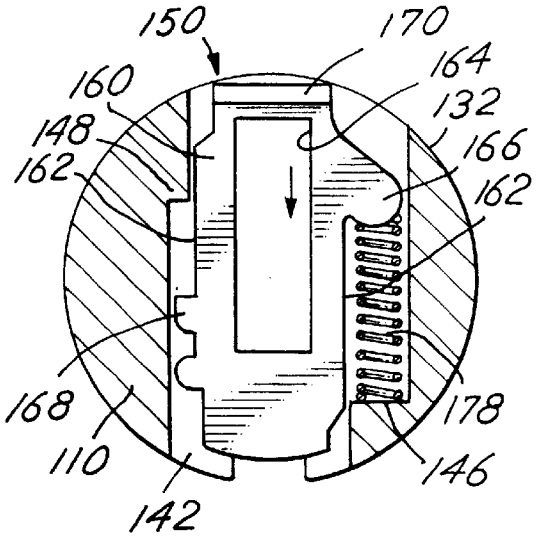
FIG. 4 is a similar view of the lock plug assembly of FIG. 3, with the reciprocating combinating tumbler in a retracted position.

Each tumbler 150 of the lock plug assembly 100 is slidably disposed within respective cavities 142 of the lock plug barrel 110 and includes a generally planar (i.e., flat) body portion 160 having a dimensional thickness 161, opposed side walls 162, a generally rectangular opening 164 extending through the thickness 161 (for receiving key 51), a shoulder 166 disposed along one of the side walls 162, and a protrusion 168 disposed along the other side wall 162. As best shown in FIGS. 3 and 4, a helical coil spring 178 is compressibly disposed between the shoulder 166 of each tumbler 150 and a first interior ledge portion 146 of the lock plug barrel 110 for biasing the tumblers 150 radially outwardly. In order to prevent the tumblers 150 from exiting the cavities 142, the protrusion 168 of each tumbler 150 may engage a second interior ledge portion 148 of the lock plug barrel 110 which acts as a stop for the tumbler 150. In use, the tumblers 150 are movable into and out of engagement with the splines 26 and 28 of the housing 10 when the keyway slot 136 of the lock plug barrel 110 and the openings 164 of the tumblers 150 are received by the normal key 51. Of course, the lock plug assembly 100 is prevented from rotating within the aperture 20 of the housing 10 when the tumblers 150 are received by one of the splines 26 or 28 of the housing 10.

Figure 9:
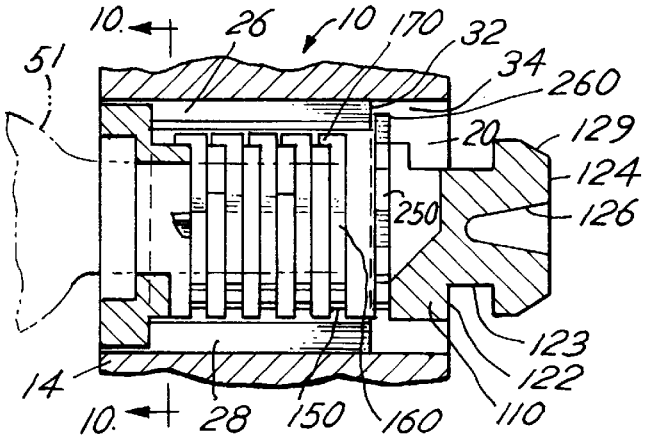
FIG. 9 is a longitudinal diametrical cross-sectional view of the lock plug assembly and housing depicted in FIG. 1, with a normal key inserted therein (i.e., with the reciprocating combinating tumblers in the retracted position and the retention tumbler in the deactivated position)
Figure 10:
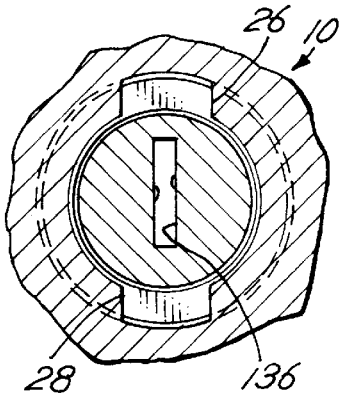
FIG. 10 is a cross-sectional view of the lock plug assembly and housing as seen in the direction of line 10—10 in FIG. 9.

In accordance with an important aspect of the present invention, each tumbler 150 also includes a bent-over end portion (or enlarged end portion) 170 which reciprocates into and out of engagement with the splines 26 and 28 of the housing 10. In operation, the biasing provided by the springs 178 normally cause each tumbler 150 to assume an extended position (i.e., a position wherein the bent-over end portion 170 of each tumbler 150 is disposed radially outwardly of the outer periphery 132 of the lock plug barrel 110 such that the bent-over end portion 170 protrudes into and is received by one of the splines 26 or 28 of the aperture 20), as shown, for example, in FIGS. 3 and 7. When normal key 51 is inserted into the keyway slot 136 of the lock plug barrel 110 and through the openings 164 of the tumblers 150, however, the biasing provided by the springs 178 is overcome which causes the tumblers 150 to move downwardly into a retracted position (i.e., a position wherein the bent-over end portion 170 of each tumbler 150 is disposed radially inwardly of the outer periphery 132 of the lock plug barrel 110 such that the bent-over end portion 170 is incapable of protruding into or being received by one of the splines 26 or 28 of the aperture 20), as depicted in FIGS. 4 and 9. Of course, rotation of the lock plug assembly 110 within the aperture 20 of the housing 10 is allowed when the tumblers 150 are in the retracted position, but is prevented when the tumblers 150 are in the extended position.

Figure 7:
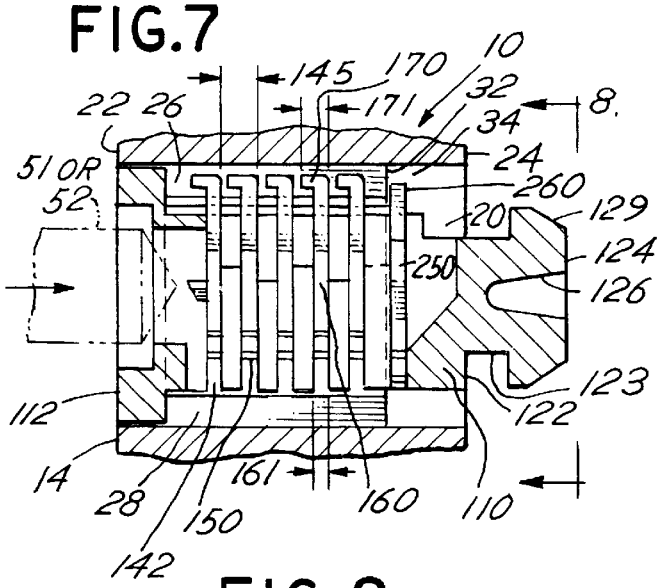
FIG. 7 is a longitudinal diametrical cross-sectional view of the lock plug assembly and housing depicted in FIG. 1, with the reciprocating combinating tumblers in the extended position and the retention tumbler in the deactivated position.

In accordance with certain important objects of the present invention, the bent-over (or enlarged) end portion 170 of each tumbler 150 has a dimensional thickness 171 in a direction along the longitudinal axis 134 of the lock plug barrel which is greater than the thickness 161 of the flat body portion 160, as shown, for example, in FIG. 7. In this way, the bent-over end portion 170 of each tumbler 150 provides additional surface contact between the tumblers 150 and the splines 26 and 28 of the housing 10 when the tumblers 150 are in the extended position. As a direct consequence, the bent-over end portions 170 of the tumblers 150 provide significant resistance to cutting, shearing, breaking, or the like when, for example, a tool or utensil (not shown) is inserted into the lock plug assembly 100 and a rotational force is applied thereto in an attempt to force the tumblers 150 through the material adjacent to the spline 26 or 28 during an attempted theft, an act of vandalism, or the like. By way of example, if the housing 10 is formed of a high impact material (e.g., polycarbonate plastic) and is subjected to a cold temperature, the bent-over end portion 170 of each tumbler 150 makes it much more difficult to defeat the lock plug assembly 100 by forcing the tumblers 150 to cut, shear, or break through the relatively brittle material which surrounds the splines 26 and 28 of the housing 10.

Figure 11:
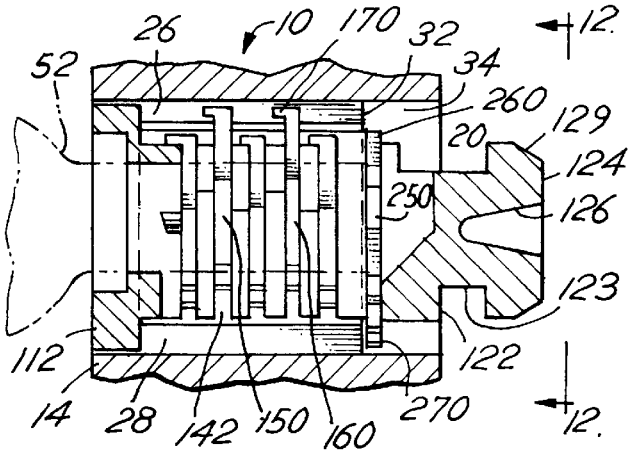
FIG. 11 is a longitudinal diametrical cross-sectional view of the lock plug assembly and housing depicted in FIG. 1, with a removal key inserted therein (i.e., with the retention tumbler in the activated position)
Figure 12:
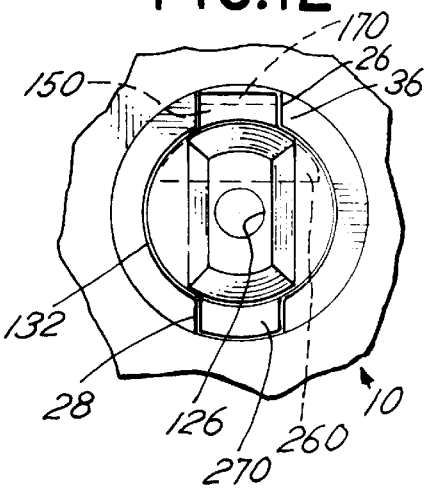
FIG. 12 is an end view of the lock plug assembly and housing as seen in the direction of line 12—12 in FIG. 11.

In the illustrated embodiment, the bent-over end portion 170 of each tumbler 150 is substantially perpendicular to the flat body portion 160 thereof (i.e., each tumbler 150 is substantially L-shaped when viewed from the side, as shown, for example, in FIGS. 7, 9, and 11). Of course, the dimensional thickness 171 of the bent-over end portion 170 must be less than the distance 145 between each cavity 142 in order to provide sufficient axial clearance between each tumbler 150, as shown in FIG. 7. In addition, the bent-over portion end 170 must also have a width 173 which is less than the width 29 of the splines 26 and 28 in order to provide sufficient transverse clearance between each tumbler 150 and the sides of the splines 26 and 28 when the tumblers 150 are in the extended position, as shown, for example, in FIG. 8. In application, each tumbler 150 is preferably formed of durable high strength material, such as steel.

Although the tumbler 150 of the present invention is depicted as substantially L-shaped, it will be understood by those skilled in the art that the term "bent-over end portion 170" is not necessarily limited to the formation of a substantially L-shaped upper end portion by way of a bending operation. Instead, the upper end portion of the tumbler 150 could, for example, be an enlargement formed via a stamping, welding, coating, or other operation which serves to augment the dimensional thickness 171 of the end of the tumbler 150 in a way that provides additional surface area between the tumbler 150 and the spline 26 or 28 of the housing 10.

In order to prevent snow, ice, and other debris from entering the keyway slot 136 of the lock plug barrel 110, the lock plug assembly 100 of the present invention may further include a dust shutter 180 slidably disposed in a void 114 in the front end 112 of the lock plug barrel 110, as well as a cap 190 attached to the front end 112 of the lock plug barrel 110 for retaining the dust shutter 180 within the void 114. As best shown in FIG. 2, the cap 190 includes a generally circular face portion 192 with a generally rectangular orifice 194 formed therein, and a generally cylindrical sleeve portion 196 which fits over the front end 112 of the lock plug barrel 110. Of course, in order to permit key 51 to properly enter the lock plug assembly 100, the orifice 194 of the cap 190 should be aligned with the keyway slot 136 of the lock plug barrel 110. In operation, the dust shutter 180 is biased by a helical coil spring 188 such that the dust shutter 180 normally covers the keyway slot 136 of the lock plug barrel 110. When key 51 is inserted into the orifice 194 of the cap 190, however, the biasing provided by spring 188 is overcome and the dust shutter 180 is slidably moved away from the keyway slot 136 so as to provide convenient access to the openings 164 of the tumblers 150.

Figure 5:
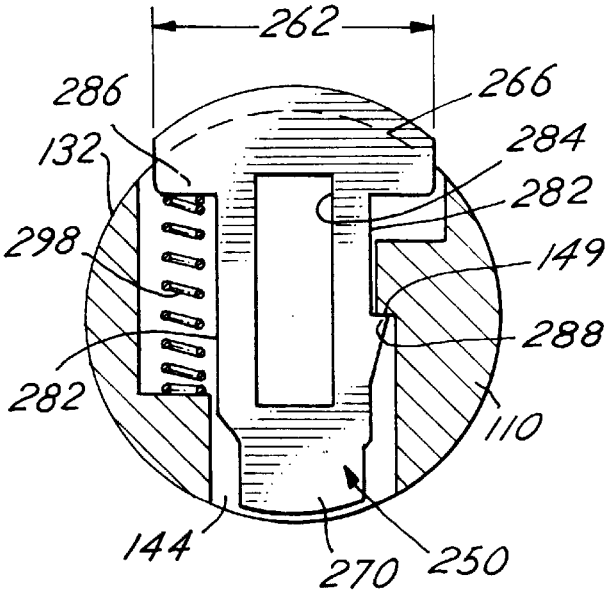
FIG. 5 is an enlarged transverse cross-sectional view of the lock plug assembly taken along line 5—5 of FIG. 2, with the retention tumbler in a deactivated position.
Figure 6:
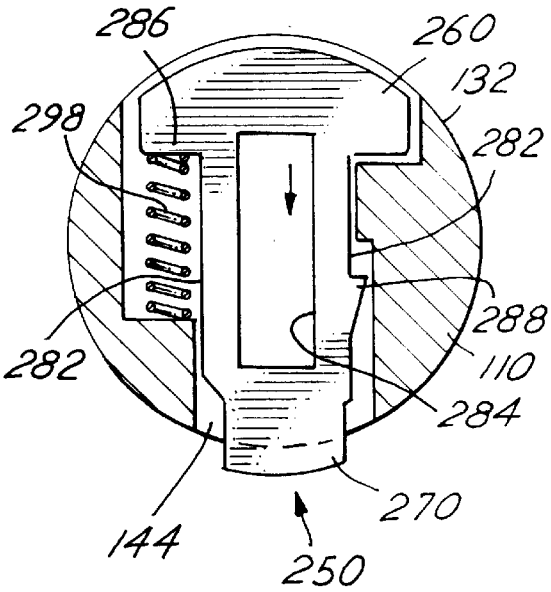
FIG. 6 is a similar view of the lock plug assembly of FIG. 5, with the retention tumbler in an activated position.

In order to permit selective removal of the lock plug assembly 100 from the aperture 20 of the housing 10, a substantially flat retention tumbler 250 may be advantageously disposed in the rearwardmost cavity 144 of the lock plug barrel 110. As best shown in FIGS. 5 and 6, the retention tumbler 250 includes an expanded (i.e., wide) and generally arcuate first end 260, a narrow second end 270, opposed side walls 282, and a generally rectangular opening 284 for receiving a specially-adapted second key (i.e., removal key) 52. As in the reciprocating combinating tumblers 150, the retention tumbler 250 also includes a shoulder 286 which compressibly engages a helical coil spring 298, and a protrusion 288 disposed along the opposite side wall 282 which engages a rear interior ledge portion 149 of the lock plug barrel 110 in order to prevent the retention tumbler 250 from exiting the rearwardmost cavity 144 of the lock plug barrel 110.

As shown in FIGS. 7–9 and 11, the splines 26 and 28 of the housing 10 terminate short of the aft end 24 of the aperture 20 (at 32) so that the expanded first end 260 of the retention tumbler 250 may be received by an annular clearance space 34 disposed between the aft end 24 of the housing 10 and the rear end 32 of the splines 26 and 28. In this way, the housing 10 also includes a rearward peripheral edge (or blockage) 36 with two openings corresponding to splines 26 and 28.

Figure 8:
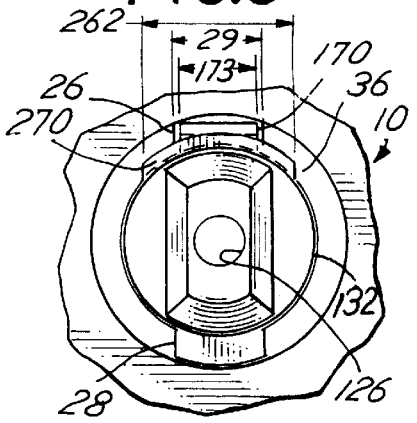
FIG. 8 is an end view of the lock plug assembly and housing as seen in the direction of line 8—8 in FIG. 7.

In operation, the biasing provided by spring 298 normally causes the retention tumbler 250 to assume a deactivated position (i.e., a position wherein the expanded first end 260 is disposed radially outwardly of the outer periphery 132 of the lock plug barrel 110 and protrudes into the annular clearance space 34 of the housing 10), as shown in FIGS. 7–9. When the retention tumbler 250 is in the deactivated position, the lock plug assembly 100 of the present invention is not removable from the housing 10 because the width 262 of the expanded first end 260 is greater than the width 29 of the splines 26 and 28, as shown, for example, in FIG. 8. Thus, should a pulling force be exerted on the lock plug assembly 100 when the retention tumbler 250 is in the deactivated position, the expanded first end 260 will engage the rearward peripheral edge 36 of the aperture 20 of the housing 10 which will prevent the lock plug assembly 100 from being removed from the housing 10.

If, however, the specially-adapted removal key 52 is inserted into the keyway slot 136 of the lock plug barrel 110, through the openings 164 of the reciprocating combinating tumblers 150, and through the opening 284 of the retention tumbler 250, the biasing provided by spring 298 is overcome which causes the retention tumbler 250 to move downwardly into an activated position (i.e., a position wherein the expanded first end 260 is disposed radially inwardly of the outer periphery 132 of the lock plug barrel 110 and does not protrude into the annular clearance space 34 of the housing 10), as shown, for example, in FIGS. 6 and 11. In addition, the narrow second end 270 of the retention tumbler 250 is received by one of the splines 26 or 28 of the housing 10 when the retention tumbler 250 is in the activated position (see, e.g., FIG. 12). In any event, the lock plug assembly 100 of the present invention is removable from the housing 10 when the retention tumbler 250 is in the activated position because the expanded first end 260 does not protrude into the annular clearance space 34 of the housing 10 and, thus, is incapable of engaging the rearward peripheral edge 36 of the aperture 20.

Of course, in order for the removal key 52 to be able to reach the opening 284 of the retention tumbler 250, it must be longer than the normal key 51. Also, the removal key 52 does necessarily not need to move the reciprocating combinating tumblers 150 into the retracted position (see, e.g., FIGS. 11 and 12) in order to effectuate removal of the lock plug assembly 100.

While the present invention has been described and disclosed with an emphasis upon a preferred embodiment, it will be understood, of course, that the present invention is not limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. In a lock assembly comprising a plastic housing with an aperture formed therein and a lock plug barrel selectively rotatably received by the aperture, a reciprocating combinating disk tumbler comprising:

a flat body portion extendable outwardly of an outer periphery of the lock plug barrel and slidably received by a cavity of the lock plug barrel, the body portion having opposed side walls, a thickness, and an opening therethrough for receiving a key;

an operating end adapted to reciprocate inwardly and outwardly with respect to the outer periphery of the lock plug barrel between retracted and extended positions when the key is inserted through and withdrawn from the opening of the body portion; and a bent-over portion disposed across the operating end, the bent-over portion having a thickness which is appreciably greater than the thickness of the body portion and a width which substantially spans the operating end, the bent-over portion being adapted to engage a generally parallel side surface of a spline formed along the aperture of the plastic housing when in the extended position to prevent rotation of the lock plug barrel with respect to the plastic housing and to provide additional surface contact between the tumbler and the side surface which resists attempts to force the tumbler through plastic housing material in the vicinity of the spline.

2. A lock assembly comprising:

a plastic housing having an aperture formed therein, the aperture having a forward end, an aft end, and a spline extending from the forward end thereof, the spline having generally parallel side surfaces;

a lock plug barrel selectively rotatably received by the aperture of the housing, the lock plug barrel having a front end, a rear end, a generally cylindrical outer periphery, a longitudinal axis, a keyway slot extending from the front end and formed substantially along the longitudinal axis, and a plurality of spaced-apart cavities extending radially inwardly from the outer periphery and arranged substantially perpendicular to the keyway slot; and reciprocating combinating disk tumblers slidably disposed within respective cavities of the lock plug barrel, each tumbler including a flat body portion extendable outwardly of the outer periphery of the lock plug barrel, an operating end, and a bent-over portion disposed across the operating end, the body portion of each tumbler having opposed side walls, a thickness in a direction along the longitudinal axis of the lock plug barrel, and an opening therethrough, the bent-over portion of each tumbler having a width which substantially spans the operating end and a thickness in a direction along the longitudinal axis of the lock plug barrel which is appreciably greater than the thickness of the body portion, each tumbler reciprocating between an extended position wherein the operating end is disposed radially outwardly of the outer periphery of the lock plug barrel and protrudes into the spline of the aperture and a retracted position wherein the operating end is disposed radially inwardly of the outer periphery of the lock plug barrel and does not protrude into the spline of the aperture, the lock plug barrel being non-rotatable in the aperture of the housing when the tumblers are in the extended position and being rotatable in the aperture of the housing when the tumblers are in the retracted position, the tumblers being movable into the retracted position when the keyway slot of the lock plug barrel and the openings of the tumblers are received by a properly-fitting key, the bent-over portions of the tumblers being positioned to engage the generally parallel side surfaces of the spline when in the extended position and to provide additional surface contact between the tumblers and side surfaces which resists attempts to force the tumblers through plastic housing material adjacent to the spline.

3. The lock assembly set forth in claim 2, wherein the tumblers are formed of metal.

4. The lock assembly set forth in claim 2, wherein the body portion and the bent-over portion of each tumbler have a generally L-shaped configuration.

5. The lock assembly set forth in claim 4, wherein each cavity of the lock plug barrel is spaced-apart by a predetermined distance which is greater than the thickness of the bent-over portion of each tumbler.

* * * * *